US007238277B2

(12) United States Patent
Dahlberg et al.

(10) Patent No.: US 7,238,277 B2
(45) Date of Patent: Jul. 3, 2007

(54) HIGH CONVERSION HYDROPROCESSING

(75) Inventors: Arthur J. Dahlberg, Benicia, CA (US); Ujjal K. Mukherjee, Montclair, NJ (US); Jerome F. Mayer, Novato, CA (US); Wai Seung W. Louie, Brooklyn, NY (US)

(73) Assignee: Chevron U.S.A. Inc., San Ramon, CA (US)

( * ) Notice: Subject to any disclaimer, the term of this patent is extended or adjusted under 35 U.S.C. 154(b) by 442 days.

(21) Appl. No.: 11/015,902

(22) Filed: Dec. 16, 2004

(65) Prior Publication Data

US 2006/0131212 A1 Jun. 22, 2006

(51) Int. Cl.
*C10G 69/02* (2006.01)
*C10G 45/00* (2006.01)

(52) U.S. Cl. ..... 208/58; 585/59; 585/89; 585/97; 585/100; 585/210

(58) Field of Classification Search ..... None
See application file for complete search history.

(56) References Cited

U.S. PATENT DOCUMENTS 5,980,729 A 11/1999 Kalnes et al.
6,241,876 B1 6/2001 Tsao et al.
6,787,025 B2 9/2004 Mukherjee et al.
6,797,154 B2 9/2004 Mukherjee et al.
7,128,828 B1 * 10/2006 Kalnes ..... 208/89

* cited by examiner

*Primary Examiner*—Tam M. Nguyen
(74) *Attorney, Agent, or Firm*—Penny L. Prater

(57) ABSTRACT

In the refining of crude oil, hydroprocessing units such as hydrotreaters and hydrocrackers are used to remove impurities such as sulfur, nitrogen, and metals from the crude oil. They are also used to convert the feed into valuable products such as naphtha, jet fuel, kerosene and diesel. The current invention provides very high to total conversion of heavy oils to products in a single high-pressure loop, using multiple reaction stages. The second stage or subsequent stages may be a combination of co-current and counter-current operation. The benefits of this invention include conversion of feed to useful products at reduced operating pressures using lower catalyst volumes. Lower hydrogen consumption also results. A minimal amount of equipment is employed. Utility consumption is also minimized.

20 Claims, 1 Drawing Sheet

HIGH CONVERSION HYDROPROCESSING

FIELD OF THE INVENTION

The invention relates to hydrocracking, and more particularly to multistage hydrocracking.

BACKGROUND ON THE INVENTION

In the refining of crude oil, vacuum gas oil hydrotreaters and hydrocrackers are employed to remove impurities such as sulfur, nitrogen and metals from the feed. Typically, the middle distillate boiling material (boiling in the range from 250° F.-735° F.) from VGO hydrotreating or moderate severity hydrocrackers does not meet the smoke point, the cetane number or the aromatic specification required.

Removal of these impurities in subsequent hydroprocessing stages (often known as upgrading), creates more valuable middle distillate products. Hydroprocessing technology (which encompasses hydrotreating, hydrocracking and hydrodewaxing processes) aims to increase the value of the crude oil by fundamentally rearranging molecules. The end products are also made more environmentally friendly.

In most cases, this middle distillate is separately upgraded by a middle distillate hydrotreater or, alternatively, the middle distillate is blended into the general fuel oil pool or used as home heating oil. Recently hydroprocessing schemes have been developed which permit the middle distillate to be hydrotreated in the same high pressure loop as the vacuum gas oil hydrotreating reactor or the moderate severity hydrocracking reactor. The investment cost saving and/or utilities saving are significant since a separate middle distillate hydrotreater is not required.

There are U.S. patents which are directed to multistage hydroprocessing within a single high pressure hydrogen loop. In U.S. Pat. No. 6,797,154, high conversion of heavy gas oils and the production of high quality middle distillate products are possible in a single high-pressure loop with reaction stages operating at different pressure and conversion levels. The flexibility offered is great and allows the refiner to avoid decrease in product quality while at the same time minimizing capital cost. Feeds with varying boiling ranges are introduced at different sections of the process, thereby minimizing the consumption of hydrogen and reducing capital investment.

U.S. Pat. No. 6,787,025 also discloses multi-stage hydroprocessing for the production of middle distillates. A major benefit of this invention is the potential for simultaneously upgrading difficult cracked stocks such as Light Cycle Oil, Light Coker Gas Oil and Visbroken Gas Oil or Straight-Run Atmospheric Gas Oils utilizing the high-pressure environment required for mild hydrocracking.

U.S. Pat. No. 5,980,729 discloses multistage hydrocracking, with a hot hydrogen stripper located between the hydrotreating and hydrocracking zones.

U.S. Pat. No. 6,241,876 teaches the use of countercurrent flow in hydrocrackers to maximize diesel production.

SUMMARY OF THE INVENTION

This invention, as are those discussed above, is directed to processes for upgrading the fraction boiling in the middle distillate range which is obtained from VGO hydrotreaters and moderate severity hydrocrackers. It is also directed to cracking VGO (vacuum gas oil) to near extinction. This invention preferably involves a multiple stage process employing a single hydrogen loop. It could, however, be used in any fixed bed hydroprocessing scheme such as mild hydrocracking, conventional single stage or multi-stage hydrocracking and hydrotreating applications.

The instant invention provides numerous economic advantages. In the preferred embodiment of this invention, co-current downflow and counter-current flow are occurring simultaneously in the second or subsequent hydroprocessing stage. Material may be removed from the second stage without passing through all of the beds, in order to prevent overcracking.

Furthermore, the reaction zones are optimized for specific feeds, resulting in lower hydrogen consumption and lower catalyst volume employed. This invention provides much higher conversion than that obtained in normal once-through hydrocrackers.

As depicted in the FIGURE, a recycle pump is employed in this invention to move the bottoms material to the second stage.

The invention is summarized as follows (further details are found in the Description of the Preferred Embodiment):

An integrated hydroprocessing method having at least two stages, each stage having at least one reaction zone and the second stage having an intermediate effluent and a bottoms effluent, said method comprising the following steps:

(a) combining an oil feed with a hydrogen-rich gas stream to form a feedstock;

(b) passing the feedstock to a reaction zone of the first stage, which is maintained at conditions sufficient to effect a boiling range conversion and contacting it with hydroprocessing catalyst;

(c) passing the effluent of step (b) to a hot high pressure separator, where it is combined with the bottoms effluent of the second stage and separated into an overhead fraction and bottoms fraction;

(d) mixing the overhead fraction of step (c) with the intermediate effluent from the second stage to form a combined stream which is passed to a cold high pressure separator;

(e) separating the combined stream of step (d) into a gaseous component, a hydrocarbon liquid stream and a sour water stream;

(f) passing the gaseous component of step (e), which comprises hydrogen, to a recycle gas compressor;

(g) combining the hydrocarbon liquid stream of step (e) with an overhead stream from a hot low pressure separator;

(h) passing the stream of step (g) to a cold low pressure separator, where it is separated into an overhead stream which is subsequently fractionated into hydrogen and other product streams, and a bottoms stream, which is combined with a bottoms effluent of the hot low pressure separator from step (g);

(i) passing the bottoms fraction of step (c) to the hot low pressure separator of step (g), where it is separated into the overhead stream of step (g) and into the bottoms effluent of step (h);

(j) passing the combined stream of step (h) to a product stripper, in which the stream is contacted countercurrently with steam to produce an overhead stream and a bottoms stream;

(k) passing the bottoms stream of steps) to fractionation, thereby producing product streams and a bottoms stream;

(l) recycling the bottoms of step (k) to a reaction zone of the second stage, which is maintained at conditions sufficient to effect a boiling range conversion, and contacting it with hydroprocessing catalyst.

BRIEF DESCRIPTION OF THE FIGURE

The FIGURE illustrates an integrated multistage hydroprocessing scheme. The second stage illustrates both co-current and counter-current zones of hydrogen flow, with a flash zone in between for the removal of an intermediate effluent.

DETAILED DESCRIPTION OF THE INVENTION

Figure 1:
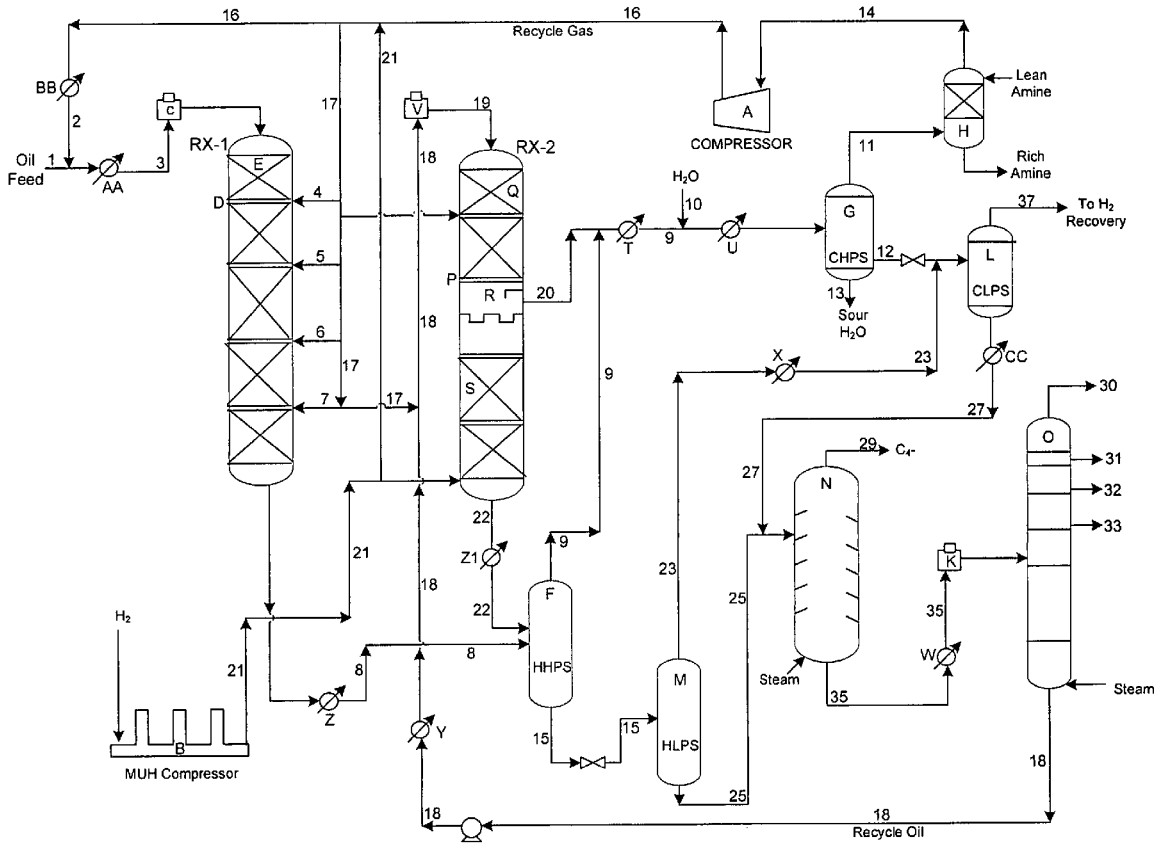

Please refer to the FIGURE. Feed in stream 1 is mixed with preheated recycle gas (exchanger BB) in stream 2. Stream 2 is a mixture of recycle gas from the recycle gas compressor (stream 16) and compressed high-purity make up gas from the make-up hydrogen compressor B (stream 21). Stream 3 is preheated in heat exchangers AA and first stage reactor feed furnace C and sent to the first reaction stage D. The first bed of first reaction stage D may contain hydrotreating catalyst suitable for treating VGO. The bed may alternately contain a mix of hydrotreating, demetallation and hydrocracking catalysts. There may be a succession of fixed beds E, with interstage quench streams, 4, 5,6,7 delivering cold hydrogen in between the beds.

The effluent 8 of the first reaction stage D, which has been hydrotreated and partially hydrocracked, contains hydrogen sulfide, ammonia, light gases, naphtha, middle distillate and hydrotreated heavy gas oil. The effluent enters the hot high-pressure separator F (which operates as a flash drum), after being cooled in exchanger Z. Vapor stream from F, stream 9, containing the light gases, naphtha and middle distillates, along with the hydrogen sulfide and ammonia, is cooled by stream 20 (intermediate stream from the second reaction stage P), which is added to stream 9, as well as by process heat exchange in exchangers T and U. Water (stream 10) is injected into stream 9 to remove most of the ammonia and an equimolar quantity of hydrogen sulfide as ammonium bisulfide solution. Stream 9 (now containing stream 20 as well) is then cooled and sent to the cold high-pressure separator (G). The overhead stream from (G) contains hydrogen, light hydrocarbonaceous gases and hydrogen sulfide (stream 11). If the sulfur content of the oil feed in stream 1 is high, stream 11 may be sent through an amine absorber (H) to remove hydrogen sulfide from the hydrogen-rich stream. The hydrogen-rich gas (stream 14) is then sent to the recycle gas compressor A for recompression and recycle back to the reactor sections in stream 16. Hydrocarbon liquid stream (stream 12) from (G) is let down in pressure to recover additional hydrogen in the cold low-pressure separator (L). The sour water stream (13) which exits G contains all of the ammonium bisulfide.

Stream 15 from F, contains the bulk of the effluents from the reaction stages D and P. Stream 15 is reduced in pressure and sent to the Hot Low Pressure Separator (M). Hydrogen-rich vapor and light hydrocarbonaceous material is removed overhead through stream 23 (and cooled in exchanger X) and sent to Cold Low Pressure Separator L (combining with stream 12) for recovery of hydrogen. The FIGURE indicates that the overhead material in stream 37 is passed to hydrogen recovery. Bottoms from L (cooled in exchanger CC) and M (streams 27 and 25 respectively) are sent to the Product Stripper (N) for the recovery of products. The Product Stripper (N) contains packing material, useful for mass transfer in fractionation. Butane, lighter gases and part of the naphtha are removed overhead in stream 29. Bottoms material is removed through stream 35 and heated (using heat exchanger W and furnace K) before entering fractionator (0). Bottoms from the fractionator (stream 18) is preheated in exchanger Y and furnace V and combined with recycle hydrogen gas (stream 17), then pumped back to the second stage reaction section (P). The mixture of unconverted oil from the first reaction stage and gas (stream 19) is first passed over a hydrocracking catalyst in zone Q of the second stage. This section is co-current in the sense that gas and liquid flow unidirectionally (downwards). After partial conversion of reactants to products, the mixture is flashed in zone R. Light gases, naphtha, kerosene and part of the diesel range material is removed via stream 20. Heavy unconverted oil and some diesel then passes down through a distributor tray to the counter-current zone S of the second reaction stage where the downflowing liquid comes in intimate contact with pure make up hydrogen coming up the reaction zones via stream 21. This counter-current contacting creates a very favorable environment for aromatics saturation (lower temperature and higher hydrogen partial pressure). In the counter-current reactor the forward reaction is favored for both aromatic saturation and hydrocracking. The net result is much smaller catalyst volume required to achieve complete conversion for a given product quality. In addition, the counter current reaction bed minimizes the polycyclic aromatics in the recycle stream 22. The net result is less fouling and coking in the second stage P.

Reactor effluent from the second reaction stage (stream 22) is routed to the hot high-pressure separator (F) for recovery of hydrogen and liquid products. Enroute, it is cooled in exchanger Z1.

There are at least two, preferably three to four, beds of hydrocracking catalyst in reactor P. The catalyst system can comprise either on base or noble metals. The final reaction zone, S, is particularly attractive for noble metal application.

Feeds

A wide variety of hydrocarbon feeds may be used in the instant invention. Typical feedstocks include any heavy or synthetic oil fraction or process stream having a boiling point above 392° F. (200° C.). Such feedstocks include vacuum gas oils (VGO), heavy coker gas oil (HCGO), heavy atmospheric gas oil (AGO), light coker gas oil (LCGO), visbreaker gas oil (VBGO), demetallized oils (DMO), vacuum residua, atmospheric residua, deasphalted oil (DAO), Fischer-Tropsch streams, Light Cycle Oil, and Light Cycle Gas Oil and other FCC product streams.

Products

The process can be used over a broad range of applications as shown in the following table.

| Oil Feed | Catalyst System | Operating Conditions | Products |
|---|---|---|---|
| VGO | Stage I - Hydrotreating + Hydrocracking | Stage I: | Maximum Diesel |
| HCGO | Stage 2 - Hydrocracking | P: 1000 psia–3000 psig | Maximum Jet + Diesel |
| DAO | | LHSV = 0.3–4.0 | Maximum Naphtha |

-continued

| Oil Feed | Catalyst System | Operating Conditions | Products |
|---|---|---|---|
| VBGO | | T: 600–850 F. | |
| | | Stage 2: | |
| DMO | | P: 1000–3000 psig | |
| | | LHSV = 0.5–5.0 | |
| | | T: 500–800 F. | |
| AGO, | Stage I - | Stage I: | Maximum Diesel |
| LCO, | Hydrotreating + Hydrocracking | P: 1000 psig–3000 psig | Maximum Jet + Diesel |
| LCGO | Stage 2 - Hydrocracking | LHSV = 0.5–4.0 | Maximum Naphtha |
| | Or | T: 600–850 F. | |
| | Stage 2 - Zone Q Base Metal | Stage 2: | |
| | hydrocracking | P: 1000–3000 psia | |
| | Stage 2 - Zone S - Aromatic Saturation | LHSV = 0.5–5.0 | |
| | (Noble-metal) | T: 500–750 F. | |

The process of this invention is especially useful in the production of middle distillate fractions boiling in the range of about 250-700 F (121-371 C). A middle distillate fraction is defined as having an approximate boiling range from about 250 to 700 F. At least 75 vol %, preferably 85 vol % of the components of the middle distillate have a normal boiling point of greater than 250 F. At least about 75 vol %, preferably 85 vol % of the components of the middle distillate have a normal boiling point of less than 700 F. The term "middle distillate" includes the diesel, jet fuel and kerosene boiling range fractions. The kerosene or jet fuel boiling point range refers to the range between 280 and 525 F (138-274 C). The term "diesel boiling range" refers to hydrocarbons boiling in the range from 250 to 700 F (121-371 C).

Gasoline or naphtha may also be produced in the process of this invention. Gasoline or naphtha normally boils in the range below 400° F. (204 C), or $C_5$ to 400° F. Boiling ranges of various product fractions recovered in any particular refinery will vary with such factors as the characteristics of the crude oil source, local refinery markets and product prices.

Conditions

Hydroprocessing conditions is a general term which refers primarily in this application to hydrocracking or hydrotreating.

Hydrotreating conditions include a reaction temperature between 400° F.-900° F. (204° C.-482° C.), preferably 600° F.-850° F. (315° C-464° C.); a pressure between 500 to 5000 psig (pounds per square inch gauge) (3.5-34.6 MPa), preferably 1000 to 3000 psig (7.0-20.8 MPa): a feed rate (LHSV) of 0.3 hr−1 to 20 hr−1 (v/v) preferably from 0.5 to 4.0; and overall hydrogen consumption 300 to 2000 SCF per barrel of liquid hydrocarbon feed (63.4-356 $m^3/m^3$ feed).

Typical hydrocracking conditions (which may be found in stage 1 or stage 2) include a reaction temperature of from 400° F.-950° F. (204° C.-510° C.), preferably 600° F.-850° F. (315° C.-454° C.). Reaction pressure ranges from 500 to 5000 psig (3.5-4.5 MPa), preferably 1000-3000 psig (7.0-20.8 MPa). LHSV ranges from 0.1 to 15 hr−1 (v/v), preferably 0.5 to 5.0 hr−1. Hydrogen consumption ranges from 500 to 2500 SCF per barrel of liquid hydrocarbon feed (89.1-445 $m^3H_2/m^3$ feed).

Catalyst

A hydroprocessing zone may contain only one catalyst, or several catalysts in combination.

The hydrocracking catalyst generally comprises a cracking component, a hydrogenation component and a binder. Such catalysts are well known in the art. The cracking component may include an amorphous silica/alumina phase and/or a zeolite, such as a Y-type or USY zeolite. Catalysts having high cracking activity often employ REX, REY and USY zeolites. The binder is generally silica or alumina. The hydrogenation component will be a Group VI, Group VII, or Group VIII metal or oxides or sulfides thereof, preferably one or more of molybdenum, tungsten, cobalt, or nickel, or the sulfides or oxides thereof. If present in the catalyst, these hydrogenation components generally make up from about 5% to about 40% by weight of the catalyst. Alternatively, platinum group metals, especially platinum and/or palladium, may be present as the hydrogenation component, either alone or in combination with the base metal hydrogenation components molybdenum, tungsten, cobalt, or nickel. If present, the platinum group metals will generally make up from about 0.1% to about 2% by weight of the catalyst.

Hydrotreating catalyst, if used, will typically be a composite of a Group VI metal or compound thereof, and a Group VIII metal or compound thereof supported on a porous refractory base such as alumina. Examples of hydrotreating catalysts are alumina supported cobalt-molybdenum, nickel sulfide, nickel-tungsten, cobalt-tungsten and nickel-molybdenum. Typically, such hydrotreating catalysts are presulfided.

EXAMPLE

These are the conditions and results obtained using a Middle Eastern VGO:

| | Stage 1 | Stage 2 |
|---|---|---|
| Catalyst | Ni—Mo or Ni—W or Ni—Mo—W + Zeolites | Ni—Mo or Ni—W Ni—Mo—W + Zeolites |
| LHSV, hr' (Active Catalyst) | 0.7–2.0 | 1.0–2.0 |
| Operating Temperatures: | SOR-EOR)° F. 650–825 | 500–650 (noble metal) 600–750 (base metal) |
| Reactor Inlet Pressure, psig | 1200–2800 | 1000–2800 |
| Gas/Oil Ratio (SCF/bbl) | 800–9000 | 800–9000 |
| Conversion, % | 30–70 | 30–80 (per pass) |
| Total middle distillates from process (250–700 F. cut) | | 90–98 |

This example illustrates a maximum distillate yield of high quality products, which may be obtained employing a second stage reactor of reduced catalyst volume. Second stage LHSV is generally higher than first stage LHSV due to a relatively contaminant-free environment (heteroatoms removed in first stage). It is also notable that when noble metal catalyst is used in the second stage, it generally operates at a lower temperature range than base metal catalyst.

What is claimed is:

1. An integrated hydroprocessing method having at least two stages, each stage having at least one reaction zone and the second stage having an intermediate effluent and a bottoms effluent, said method comprising the following steps:

(a) combining an oil feed with a hydrogen-rich gas stream to form a feedstock;

(b) passing the feedstock to a reaction zone of the first stage, which is maintained at conditions sufficient to effect a boiling range conversion and contacting it with hydroprocessing catalyst;

(c) passing the effluent of step (b) to a hot high pressure separator, where it is combined with the bottoms effluent of the second stage and separated into an overhead fraction and bottoms fraction;

(d) mixing the overhead fraction of step (c) with the intermediate effluent from the second stage to form a combined stream which is passed to a cold high pressure separator;

(e) separating the combined stream of step (d) into a gaseous component, a hydrocarbon liquid stream and a sour water stream;

(f) passing the gaseous component of step (e), which comprises hydrogen, to a recycle gas compressor;

(g) combining the hydrocarbon liquid stream of step (e) with an overhead stream from a hot low pressure separator;

(h) passing the stream of step (g) to a cold low pressure separator, where it is separated into an overhead stream, which is subsequently fractionated into hydrogen and other product streams, and a bottoms stream, which is combined with a bottoms effluent of the hot low pressure separator from step (g);

(i) passing the bottoms fraction of step (c) to the hot low pressure separator of step (g), where it is separated into the overhead stream of step (g) and into the bottoms effluent of step (h);

(j) passing the combined stream of step (h) to a product stripper, in which the stream is contacted counter-currently with steam to produce an overhead stream and a bottoms stream;

(k) passing the bottoms stream of step (j) to fractionation, thereby producing product streams and a bottoms stream; and (l) recycling the bottoms of step (k) to a reaction zone of the second stage, which is maintained at conditions sufficient to effect a boiling range conversion, and contacting it with hydroprocessing catalyst.

2. The method of claim 1, wherein the gaseous component of step (e) is passed through an amine absorber prior to passing to a recycle gas compressor, for the removal of $H_2S$.

3. The method of claim 1, wherein the second stage reaction zone comprises two sections, the first in which the feed flows co-currently with hydrogen, the second in which the feed flows counter-currently with hydrogen.

4. The method of claim 1, in which the first stage reaction zones comprise at least one bed of hydrotreating catalyst, hydrocracking catalyst or a combination of both, either alone or in combination with each other, and the second stage reaction zones comprise at least one bed of hydrocracking catalyst.

5. The process of claim 4, wherein the hydrocracking catalyst of the second stage comprises a base metal or base metal combination.

6. The method of claim 1, in which the first stage reaction zones comprise at least one bed of hydrotreating catalyst, hydrocracking catalyst or a combination of both, and the second stage reaction zones comprise at least one bed of aromatic saturation catalyst.

7. The method of claim 6, in which the aromatic saturation catalyst comprises a noble metal or combination of noble metals.

8. The method of claim 1, in which the feedstocks possess a boiling point of at least 392° F.

9. The method of claim 8, wherein the oil feed comprises vacuum gas oils (VGO), heavy coker gas oil (HCGO), heavy atmospheric gas oil (AGO), light coker gas oil (LCGO), visbreaker gas oil (VBGO), demetallized oils (DMO), vacuum residua, atmospheric residua, deasphalted oil (DAO), Fischer-Tropsch streams, Light Cycle Oil, Light Cycle Gas Oil and other FCC product streams.

10. The method of claim 1, in which the product stripper comprises packing material.

11. The method of claim 3, in which the intermediate effluent of the second stage comprises material from flashing of the effluent from the co-current zone of the second stage, as well as stripped product from the countercurrent zone.

12. The method of claim 11, in which the intermediate effluent comprises light gases, naphtha, kerosene and diesel range material.

13. The method of claim 1, in which the products comprise middle distillate fractions boiling in the range of from 250-700° F.

14. The method of claim 13, in which the products comprise naphtha, jet fuel, diesel and kerosene.

15. The method of claim 1, in which interbed hydrogen quench is used in stage one.

16. The method of claim 1, wherein hydrotreating conditions comprise a reaction temperature from 400° F. through 900° F. (204° C.-482° C.), a pressure from 500 through 5000 psig (pounds per square inch gauge) (3.5-34.6 MPa), a feed rate (LHSV) of from 0.5 hr−1 through 20 hr−1 (v/v) and overall hydrogen consumption of from 300 through 2000 SCF per barrel of liquid hydrocarbon feed (63.4-356 $m^3/m^3$ feed).

17. The method of claim 1, wherein hydrocracking conditions comprise a reaction temperature in the range of from 400° F. through 950° F. (204° C.-510° C.), a reaction pressure range from 500 through 5000 psig (3.5-4.5 MPa), a feed rate (LHSV) in the range of from 0.1 to 15 hr−1 (v/v) and overall hydrogen consumption in the range of from 500 to 2500 SCF per barrel of liquid hydrocarbon feed (89.1-445 $m^3H_2/m^3$ feed).

18. The method of claim 16, wherein hydrotreating conditions further comprise a reaction temperature in the range from 600° F. through 850° F. (315° C.-464° C.), a pressure in the range from 1000 through 3000 psig (7.0-20.8 MPa), a feed rate (LHSV) in the range of from 0.3 hr−1 through 4 hr−1 (v/v); and an overall hydrogen consumption in the range of from 300 to 2000 SCF per barrel of liquid hydrocarbon feed (63.4-356 $m^3/m^3$ feed).

19. The method of claim 17, wherein hydrocracking conditions further comprise a reaction temperature in the range from 600° F.-850° F. (315° C.-454° C.), a reaction pressure in the range from 1000-3000 psig (7.0-20.8 MPa) a feed rate (LHSV) in the range from 0.5-5.0 hr−1 and an overall hydrogen consumption ranges from 500 to 2500 SCF per barrel of liquid hydrocarbon feed (89.1-445 $m^3H_2/m^3$ feed).

20. The method of claim 4, in which the cracking component of the hydrocracking catalyst comprises an amorphous silica/alumina phase, a zeolite, or both.

* * * * *